United States Patent [19]

Larkin

[11] Patent Number: 4,730,728

[45] Date of Patent: Mar. 15, 1988

[54] GOLF ACCESSORY CARRYING DEVICE

[76] Inventor: Mark E. Larkin, 419 Northgate, Lindenhurst, Ill. 60046

[21] Appl. No.: 851,823

[22] Filed: Apr. 14, 1986

[51] Int. Cl.[4] ..... B65D 85/00

[52] U.S. Cl. ..... 206/315.9; 206/315.1; 224/252; 224/919; 224/918

[58] Field of Search ..... 206/37, 38, 315.1, 315.9, 206/372–376, 443, 3; 224/252, 253, 919, 918; 273/32 D, 32 B, 33; 221/307, 308, 310; 24/30.5 P

[56] References Cited

U.S. PATENT DOCUMENTS

| | | | |
|---|---|---|---|
| 1,754,495 | 4/1930 | Anderson | 224/919 |
| 1,955,650 | 4/1934 | Obarski | 273/32 D |
| 2,665,830 | 1/1954 | Fowler | 224/252 |
| 2,768,775 | 10/1956 | Houser | 224/919 |
| 3,014,595 | 12/1961 | Bartmann | 224/919 |
| 3,101,840 | 8/1963 | Canning, Jr. et al. | 206/3 |
| 3,466,077 | 9/1969 | Moberg | 24/30.5 P |
| 3,497,118 | 2/1970 | Najjar | 224/252 |
| 3,497,676 | 2/1970 | Gravatt | 206/315.9 |
| 3,516,664 | 6/1970 | Brennan | 273/33 |
| 3,669,250 | 6/1972 | Marefka | 206/37 |
| 3,768,636 | 10/1973 | O'Connell, Jr. | 221/310 |
| 3,799,331 | 3/1974 | White | 206/38 |
| 3,813,987 | 6/1974 | Minneman | 206/3 |
| 3,870,300 | 3/1975 | Amendola | 273/32 D |
| 4,020,974 | 5/1977 | Bauer et al. | 221/307 |
| 4,082,209 | 4/1978 | Sanders | 224/919 |
| 4,106,678 | 8/1978 | Thomas | 206/315.9 |
| 4,151,937 | 5/1979 | Jarosh et al. | 224/252 |
| 4,239,216 | 12/1980 | Bauer | 373/32 B |
| 4,253,830 | 3/1981 | Kazen et al. | 206/379 |
| 4,257,520 | 3/1981 | Hohmann et al. | 206/3 |
| 4,263,697 | 4/1981 | Speedie | 24/30.5 P |
| 4,296,874 | 10/1981 | Evans | 221/307 |
| 4,299,345 | 11/1981 | Lanzl | 224/252 |
| 4,416,404 | 11/1983 | Daniels | 206/315.9 |
| 4,532,679 | 8/1985 | Scott | 24/30.5 P |
| 4,537,432 | 8/1985 | Meeks | 24/30.5 P |
| 4,560,061 | 12/1985 | Haytayan | 206/3 |
| 4,613,042 | 9/1986 | Aeshliman | 206/372 |

FOREIGN PATENT DOCUMENTS

| | | | |
|---|---|---|---|
| 2128485 | 5/1984 | United Kingdom | 273/32 B |

*Primary Examiner*—David T. Fidei
*Attorney, Agent, or Firm*—A. R. Thiele

[57] ABSTRACT

A golf accessory carrying device as a central tubular portion with inwardly facing rims for holding golf balls and an outwardly extending flange for holding golf accessories. The device may also include a strap for attaching the device to a golf bag, golf cart or the like.

1 Claim, 12 Drawing Figures

GOLF ACCESSORY CARRYING DEVICE

BACKGROUND OF THE INVENTION

The present invention relates to an accessory device for golfers, more specifically, the device of the present invention relates to a golf accessory carrying device for holding golf balls and golfing paraphernalia such as golf tees, pencils for marking score cards, golf ball markers, divot repair tools and the like.

One of the common problems facing golfers is the continual loss of favored golf balls or small devices such as golf tees, divot repair tools, ball markers, pencils and the like commonly used during the game of golf. Typically, both golf balls and accessory devices are kept within a large pouch on the side of a golf bag or in a pocket of the golfer. As there is no central system to retain these devices and prevent their loss, the golfer often finds that before his round of the golf course is complete, he has either lost or misplaced a favored golf ball or one or more of the various devices used in the game of golf. This loss is usually caused by the devices falling out of golf bags when the bags are laid on the ground or falling out of pockets when the golfer bends over to tee his golf ball.

There is therefore a need to provide a system for conveniently keeping favored or selected golf balls and golfing paraphernalia in one convenient place so that the golfer may have ready access to his favored or selected golf balls and his golfing paraphernalia. Additionally, there is also a need to provide a device that will prevent the loss of favored golf balls or golfing paraphernalia during a round of the golf course.

SUMMARY OF THE INVENTION

In response to the foregoing needs, there is provided by the device of the present invention a carrying system that has the advantage of being able to easily hold, carry and retain favored or selected golf balls and golfing paraphernalia such as golf tees, score card marking pencils, divot repair tools and the like all in one place for easy accessibility by the golfer. The carrying system has two essential features. The first essential feature is a central or tubular portion for holding favored or selected golf balls. The second essential feature is an outwardly extending flange for holding various golfing accessories.

The central or tubular portion is flexible and particularly characterized in the preferred embodiment by an inwardly facing rim on either end. These rims prevent the golf balls from exiting the central or tubular portion yet allow for easy insertion or removal of the golf balls as required.

The outwardly extending flange emanates from the exterior surface of the tubular portion and is particularly characterized in the preferred embodiment by a plurality of holes. The holes are sized and arranged to accommodate a collection of commonly used golfing accessories. Extending downwardly from these holes is a tapered tubular holding member which is used to grip the golfing accessories once having been placed in the holes.

The carrying device may optionally include a third feature. This feature is a strap which is conveniently engageable with a slot formed in the outwardly extending flange. The strap may be used to attach the carrying device to a golf cart, a golf bag or the belt of a golfer.

BRIEF DESCRIPTION OF THE DRAWINGS

A better understanding of the advantages and features of the golf accessory carrying device of the present invention may be had by reference to the drawings, wherein.

Figure 2:
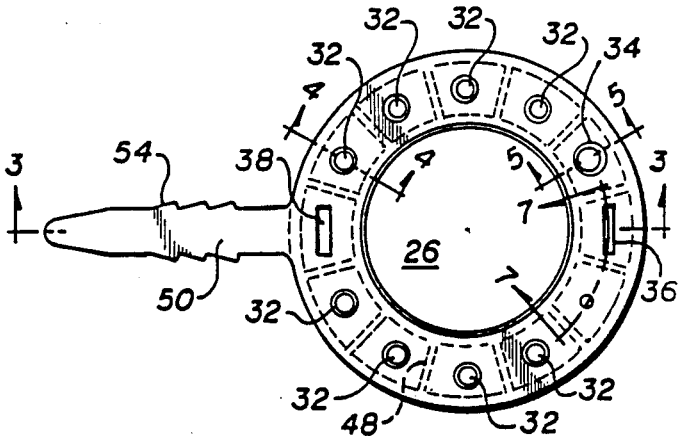
FIG. 2 is a top view of the device shown in FIG. 1 with the accessories and golf balls removed.
Figure 3:
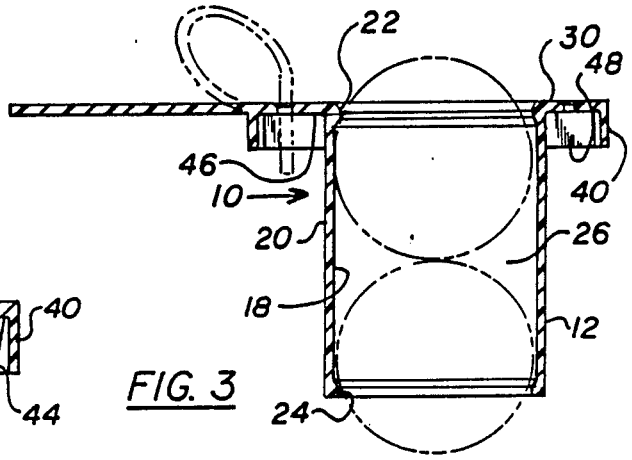
FIG. 3 is a sectional view along line 3—3 of FIG. 2.
Figure 6:
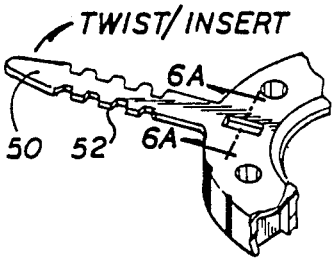
FIG. 6 is a perspective partial view of an alternate embodiment of a strap extending from the flange of the device.
Figure 7:
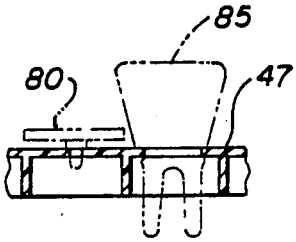
Figure 8:
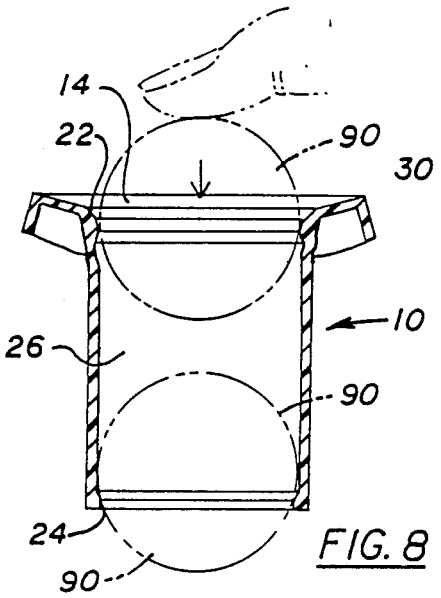
Figure 9:
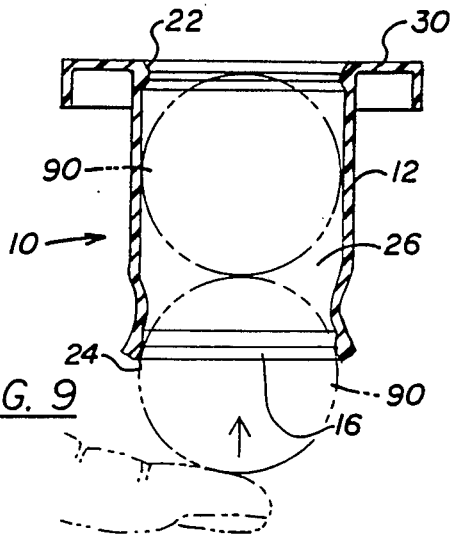
Figure 10:
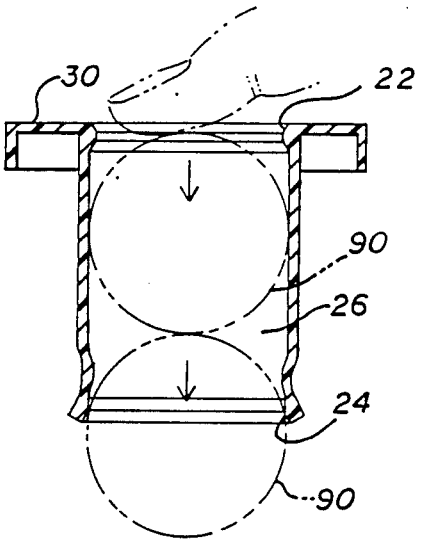
Figure 11:
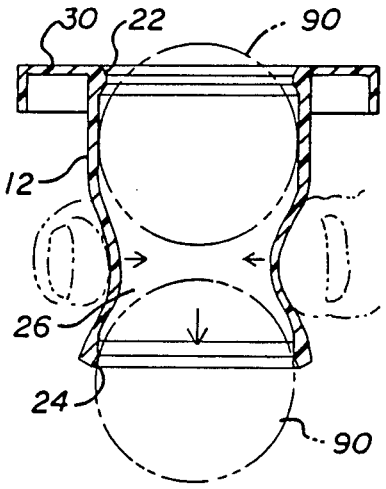

FIG. *6a* is a sectional view taken along line *6a*—*6a* of FIG. 6;

FIG. 7 is a partial sectional view taken along line 7—7 of FIG. 2;

FIGS. 8 and 9 are similar to FIG. 3 showing the loading of golf balls into the device; and FIGS. 10 and 11 are similar to FIG. 3 showing ejection of the golf balls from the device.

DETAILED DESCRIPTION OF THE EMBODIMENTS

The golf accessory carrying device 10 of the present invention has two essential parts. The first essential part is a tube 12 which forms the body of the device. The second essential portion is a flange 30 which extends outwardly from the exterior 20 of the tube 12.

Figure 1:
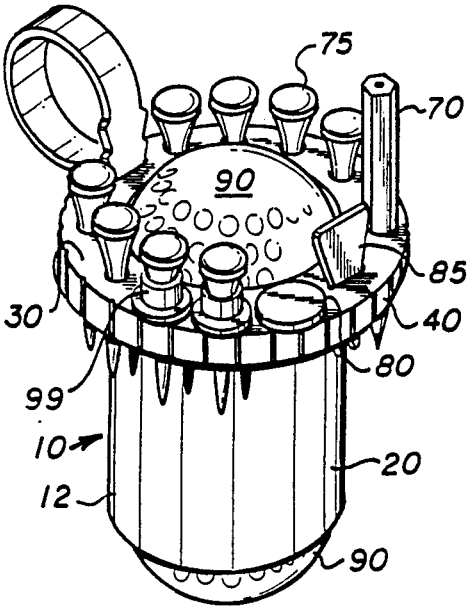
FIG. 1 is a perspective view of the golf accessory carrying device of the present invention loaded with various golfing accessories and golf balls.

As shown in FIG. 1, tube 12 forms the body or central portion of the golf accessory carrying device 10. Outwardly extending flange 30 emanates from the exterior 20 of tube 12 and is used to hold various accessories; for example, a pencil 70, golf tees 75, ball marker 80. golf balls 90 are removably retained within the hollow center portion 26 (FIG. 2) of tube 12. While shown in operative engagement with two golf balls 90 in the preferred embodiment, it will be understood that the device 10 will still be operable when accommodating only one golf ball 90 with a shortened tube 12 or three or more golf balls 90 with a lengthened tube 12.

The removable retention of golf balls 90 within the hollow center portion 26 of the device 10 is best shown by reference to FIG. 3. Therein it may be seen that a top rim 22 and a bottom rim 24 extend from the interior wall 18 of tube 12 into its hollow center portion 26. Rims 22 and 24 retain golf balls 90 within hollow center portion 26; specifically, they prevent the exiting of golf balls 90 from either the top or bottom of tube 12. The combination of rims 22 and 24 with the flexible nature of tube 12 act to add a removability feature to the retention of golf balls 90 within tube 12, as will be explained in the section below which describes the operation of the device.

As best seen in FIGS. 1 and 2, the top portion of the device is characterized by an outwardly extending flange 30. This flange is characterized as having several holes formed in its central portion. In the preferred embodiment, tee holes 32, pencil hole 34, divot tool slot 36 and strap slot 38 have been formed. Shown mounted on tee 75 is a golf tee positioning device 99 which is the subject of my copending application Ser. No. 741,577, filed June 5, 1985. The holes in flange 30 are sized to contain the most commonly used accessories which oftentimes become lost in the large pockets on the side of the golf bag or in the pockets of a golfer. It will be understood that the array of holes shown is merely illustrative of the preferred embodiment. Various arrangements of differing size holes are possible to accommodate differing tastes or regional preferances of golfers.

Surrounding flange 30 in the preferred embodiment is a downwardly depending outer skirt 40. Underneath flange 30 are ribs 48. Outer skirt 40 and ribs 48 are shown as part of the preferred embodiment, however, it will be understood that outer skirt 40 and ribs 48 may be omitted without affecting the utility of device 10. Skirt 40 and ribs 48 provide added strength should too flexible a material be used to fabricate the device. It will also be noted that while flange 30 is shown integral with the uppermost portion of tube 12, it may be located at any portion along the exterior surface 20 of tube 12 without affecting the operability of the device. Skirt 40 is shown with an optional vertical groove design. Such grooves enhance the appearance of the device and are merely illustrative of one of many designs that may be placed on skirt 40.

Figure 4:
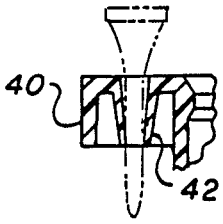
FIG. 4 is a sectional view along line 4—4 of FIG. 2.
Figure 5:
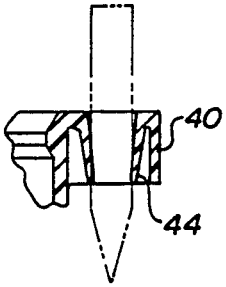
FIG. 5 is a sectional view along line 5—5 of FIG. 2.

As best shown in FIGS. 4 and 5, tapered tubes 42 and 44 extend downwardly from the lower surface 46 of flange 30. These tapered tubes 42 and 44 serve to grip various golfing accessories which are placed through the holes or slots in flange 30. The operation of these tapered tubes is shown in FIG. 4 with tee 75 (shown in phantom) and in FIG. 5 with pencil 70 (shown in phantom). When either a tee or a pencil are inserted through holes 32 and 34, respectively, the tapered tubes 42, 44 will expand slightly and grip the side surfaces of the golfing accessory to retain it in place irrespective of whether or not device 10 is tilted, laid on its side or turned over. Such tilting or upset of device 10 may occur when the device 10 is dropped or if the device 10 is attached to a golf bag which is laid on the ground while a shot is being made. While the tapered tubes 42, 44 are shown in the preferred embodiment, it will be understood that the tapered tubes 42, 44 may be eliminated without affecting the operability of the device if the holes in flange 30 are sized correctly. The use of tapered tubes 42, 44 provides adaptability for use of the carrying device 10 with a wider range of golf accessories.

As shown in FIG. 7, additional holes may be added for specialty devices such as a ball marker 80 or a particular divot repair tool 85. These holes may be sized so that a portion of ball marker 80 is caused to sit slightly off upper surface 47 of flange 30 for easy removal. Additionally, hole 36 for divot tool 85 may be sized just slightly smaller than a preselected exterior dimension of the divot tool 85 to permit divot tool 85 to snap in place.

While not essential to the operability of device 10, the preferred embodiment in FIG. 2 also includes a stra 50 for attaching the device to a golf cart, a golf bag or the belt of a golfer. The stra 50 may be sized such that it can be looped over and inserted back into a slot 38 formed in flange 30.

Figure 6A:
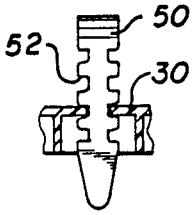

Comparing the embodiment shown in FIG. 2 to the embodiment shown in FIGS. 6 and 6*a*, it can be seen that strap 50 may include serrations 52 along its sides so that the size of the loop may be controlled by the particular serration when the strap 50 is twisted and inserted within strap slot 38. Additionally, slot 38 is rotated 90° from its position in FIG. 2. Strap 50 may also be constructed s that it need not be twisted but merely inserted into slot 38 so that barbs 54 engage the sides of slot 38.

While two embodiments of retaining strap 50 have been shown in FIGS. 2 and 6 respectively, it will be understood that a wide variety of strap designs and retention arrangements may be used for obtaining the same result.

OPERATION

The loading of golf balls 90 into device 10 is best shown in FIGS. 8 and 9. Specifically, golf balls 90 may be loaded through the uppermost portion of tube 12. The flexible nature of tube 12 permits the inner circumference of rim 22 to expand slightly as golf ball 90 is inserted into tube 12. Lower rim 24 causes golf balls 90 to remain within tube 12.

Optionally, golf balls 90 may be inserted from the bottom 16 of tube 12 instead of inserting golf balls 90 from the top 14 of tube 12. While two golf balls 90 are shown mounted in the preferred embodiment, it will be understood that device 10 may be sized to accommodate any number of golf balls. This operation may be done manually, or device 10 may be merely placed over a golf ball 90 and pressed down over the golf ball 90 so that the inner circumference of bottom rim 24 slightly expands to allow golf ball 90 to move within the interior 26 of tube 12. If another golf ball is located within the interior 26 of tube 12 it will merely slide upwardly to accommodate golf ball 90. The use of two rims 22 and 24 prevent the exiting of golf balls 90 from tubular member 12 irrespective of the position of device. Hence, the golfer may attach device 10 to his golf bag or to his belt and never be concerned about losing his golf balls.

Ejection of golf balls 90 from tube 12 is shown in FIGS. 10 and 11. Finger pressure may be placed on the uppermost golf ball 90. This finger pressure will cause the lower golf ball to expand rim 24 to a circumference large enough to allow golf ball 90 to pass through the bottom opening. If desired, tube 12 may be squeezed thus reducing the size of the interior 26 of tube 12. This reduction in size will cause golf ball 90 to engage rim 24 and cause inner circumference of rim 24 to increase to the point where golf ball 90 may pass out of the bottom 16 of tube 12. If desired, it is also possible to cause golf ball 90 to exit tube 12 from the top of 14. The exiting of golf ball 90 from the top 14 of tube 12 is similar to the exiting of golf ball 90 from the bottom of tube 12. Stiffening ribs 48 and skirt 40 serve to reduce distortion of flange 30 when tube 12 is squeezed or expanded. While continuous rims 22 and 24 are shown in the preferred embodiment, it will be understood that segmented rims may also be used without affecting the operability of device 10.

The device of the present invention may be molded by conventional techniques from a plasticized polyvinyl chloride, a thermoplastic rubber or any suitable material which is sufficiently resilient and durable to grip golf balls and golf accessory items. Different colors may be used to designate ownership of carrying devices or alternatively logos may be placed on exterior surface 20 or skirt 40 to advertise certain products.

There is thereby provided by the carrying device 10 of the present invention a system and method for first, conveniently maintaining golf balls and golf accessory items in one place within easy reach of the golfer and second, preventing their loss during active play.

While the golf accessory carrying device is described in conjunction with the preferred embodiment, it will be understood that the scope of the present invention is to be defined only by a reading of the appended claims by one of ordinary skill in the art giving reference to the specification and the drawings.

I claim:

1. A golf accessory carrying device comprising:

a flexible tubular member having an upper end and a lower end, said flexible tubular member constructed and arranged to receive and eject golf balls from either said upper and/or said lower end;

a pair of inwardly facing rims formed on the inside of said flexible tubular member at said upper end and said lower end;

an outwardly extending flange formed co-planar with the upper end of said flexible tubular member;

a plurality of various sized holes formed in said outwardly extending flange;

tapered tubular members extending downwardly from a portion of said holes, said tapered tubular members constructed and arranged to retain golf accessories;

a skirt downwardly depending from the outer edge of said outwardly extending flange;

a plurality of rib members located underneath said outwardly extending flange behind said skirt, said rib members being positioned between said tapered tubular members;

a strap member extending from said outwardly extending flange;

one of said holes being constructed and arranged to be engageable with said strap member.

* * * * *